US005186582A

United States Patent [19]

Bullivant

[11] Patent Number: 5,186,582

[45] Date of Patent: Feb. 16, 1993

[54] PROCESS FOR FORMING PILES AND PRODUCT

[76] Inventor: Roger A. Bullivant, c/o Roxbury Limited, 28 Irish Town, Gibraltar, Gibralter

[21] Appl. No.: 761,752

[22] PCT Filed: Mar. 12, 1990

[86] PCT No.: PCT/GB90/00378

§ 371 Date: Sep. 11, 1991

§ 102(e) Date: Sep. 11, 1991

[87] PCT Pub. No.: WO90/10755

PCT Pub. Date: Sep. 20, 1990

[30] Foreign Application Priority Data

Mar. 15, 1989 [GB] United Kingdom ..... 8905985

[51] Int. Cl.[5] ..... E02D 5/38; E02D 7/18

[52] U.S. Cl. ..... 405/239; 405/240; 405/243

[58] Field of Search ..... 405/233, 236, 239, 240, 405/242, 243

[56] References Cited

U.S. PATENT DOCUMENTS 3,420,067 1/1969 Bjerking ..... 405/242 X
4,126,007 11/1978 Mars ..... 405/240 X
4,165,198 8/1979 Farmer ..... 405/243

*Primary Examiner*—David H. Corbin
*Attorney, Agent, or Firm*—W. Thad Adams, III

[57] ABSTRACT

A method of forming a pile comprises driving a pile forming member (12, 40, 140) into the ground to a predetermined depth to form a passage of non-circular cross-section, preferably a circular cross-section (42) with fins (56) radiating therefrom, and while withdrawing the member (12, 40, 140) from the passage filling the passage with cementitious material so that then this material sets a pile if formed in the passage.

7 Claims, 2 Drawing Sheets

PROCESS FOR FORMING PILES AND PRODUCT

The present invention relates to piles and to their production.

Piles for use in supporting structures such as buildings are commonly pre-formed, in sections, and driven into the ground from the surface. Alternatively, they may be formed by driving a head into the earth to form a hole. A pipe extending down the hole supplies concrete or other pile material to the head. The head comprises a through passage which allows the pile material to fill the hole beneath the head as the head is withdrawn from the hole. A sacrificial cap closes the lower end of the through passage while the head is being driven to form the hole, and is left at the bottom of the hole when the head is withdrawn.

A major contribution to the supporting force provided by a pile arises from friction between the surface of the pile and the surrounding earth. This friction can be increased by increasing the size of the pile, but there is a resultant increase in the volume of pile material required. It is an object of the present invention to obviate or mitigate this problem.

According to the present invention there is provided a method of forming a pile comprising applying a downwardly directed force to a pile forming member to drive said member into the ground top a predetermined depth characterized in that said pile forming member has three or four fins projecting transversely thereof and is so driven into the grounds that the passage it forms in the ground has a cross-section corresponding to that of the member and fins and in that an upwardly directed vibratory force is applied to withdraw said member from the ground while simultaneously supplying a pile forming material through the member to fill said passage as the member is removed therefrom thereby creating a pile having a cross-section corresponding to that of the member and fins.

Preferably the pile member is driven into the ground by applying a downwardly directed vibratory force thereto.

Preferably a reinforcing member is positioned in the passage before the pile forming material sets.

Preferably the cross-section of the member is triangular.

Each fin is superimposed on said triangular cross-section member. Alternatively each fin is superimposed on an outline which is otherwise circular.

Further according to the present invention there is provided a pile formed in accordance with the method set out in the proceeding five paragraphs.

Embodiments of devices according to the present invention, and the piles produced by those devices will now be described in more detail, by way of example only, and with reference to the accompanying drawings in which.

Figure 1:
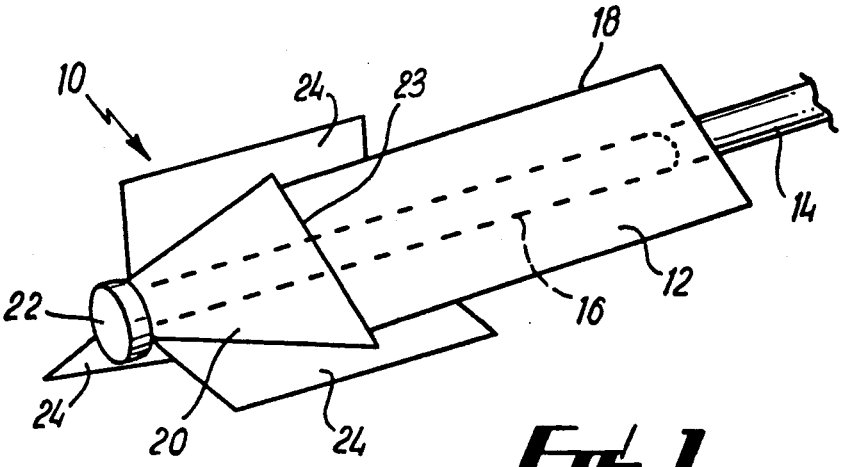
FIG. 1 is perspective view of a pile-making head according to the invention.

FIG. 1 shows a pile-making device 10 comprising a head 12 which, in use, is driven into the earth to form a hole. Means 14 in the form of a pipe are provided for supplying pile material (normally concrete) to the head 12. A through passage 16 within the head allows the pile material to fill the hole beneath the head 12 as the head is withdrawn from the hole. The device 10 may be driven into and out of a hole by any conventional technique, such as hammering, jacking or vibrating but a vibrating technique is preferred certainly for withdrawing the device from the hole.

The outermost outline of the head 12 is so shaped as to form a hole of non-circular cross-section.

In more detail, the head 12 comprises a block 18 in the form of a triangular prism whose central axis forms the axis of the head and the axis of the hole formed by the head. One end of the block 18 carries an extension 20 in the approximate form of a pyramid which causes the head to tapper from the outline of the block 18 to the mouth of the through passage 16, shown closed by a sacrificial cap 22.

The base of the pyramid is slightly larger than the cross-section of the prism, so that a small step 23 is formed where they meet. The outline of head is at its largest at this point. That is, the outermost outline of the head, when viewed along the axis of the prism, occurs only at one point along the length of the head, at the top of the step 23.

Three fins 24 project radially from the axis of the head 12 and are generally aligned in the radial planes of the edges of the block 18. It can be seen from FIG. 1 that the fins 24 project beyond the outermost outline of the block 18 and that they extend substantially further in the radial direction than in the circumferential direction. The fins may be formed, for instance, by sections of steel plate.

The head 12 is used to form a pile in the following manner. The head 12 is driven into the earth by a vibrator to form a hole to the required depth. The extension 20 and cap 22 lead as the head 12 is being driven. The pipe 14 follows the head 12 down the hole, additional sections of pipe being added as required. Since the outermost outline of the head 12, in crosssection, is triangular, with the exception of the fins 24, the head forms a generally triangular hole 26 (FIG. 2) which is extended at each corner by slots 28 formed by the fins 24. When a hole 26 to the desired depth has been formed, the head is withdrawn by reversing the direction of force applied by the vibrator as concrete is supplied through the pipe 14 and the through passage 16 to the space left in the hole below the head 12. This space is filled with concrete to leave a pile 30 which is generally triangular in cross-section, with additional flanges 32 running in each slot 28.

The taper of the pyramid 20 and the step 23 minimise the friction resistance while driving the head 12 to form the hole 26. It may be necessary to provide some means for preventing the hole collapsing behind (above) the head 12, around the pipe 14. These means could be plates which form an outline slightly smaller than the outline of the block 18, or the triangular prism 12 could be extended in sections back to the surface.

Figure 2:
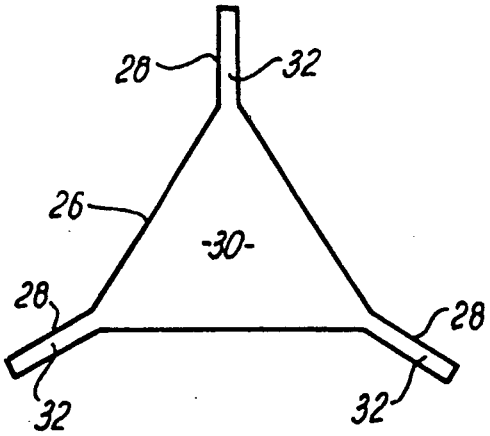
FIG. 2 is a cross-section of a pile formed using the head of FIG. 1.

The frictional force between the pile 30 and the surrounding earth is proportional to the surface area of the pile 30. It will be seen from the following explanation that the surface area of a specified volume of concrete is greater when that volume is cast in the form shown in FIG. 2 than when it is cast in the form of a conventional pile of circular cross-section. Consequently, the frictional forces and the load-bearing capacity of the pile shown in FIG. 2 are greater than those of a conventional pile formed with the same volume of concrete.

The circumference of the cross-section of a circular pile of radius R has a length ($2\pi R$). The cross-sectional area is ($\pi R^2$). The friction between the pile and the earth will be proportional to the surface area of the pile, and will therefore be proportional to ($2\pi R$) per unit length of the pile. The volume of concrete in the pile is ($\pi R^2$) per unit length.

The circumference of the cross-section of a triangular pile is 3S, if the length of each side of the triangle is S. The cross-sectional area is ($\sqrt{\frac{3}{4}S^2}$). The friction created is therefore proportional to 3S per unit length, and the volume of concrete used is ($\sqrt{\frac{3}{4}S^2}$) per unit length.

If the volume of concrete per unit length is the same in each case, then $$\pi R^2 = \sqrt{\frac{3}{4}}\, S^2$$

and $$\frac{S}{R} = \left(\frac{4\pi}{\sqrt{3}}\right)^{\frac{1}{2}}$$

The following equation therefore relates the friction produced by the piles:

$$\begin{aligned}\text{Friction (triangular pile)} &= \frac{3S}{2\pi R} \times \text{Friction (circular pile)}\\ &= \frac{3}{2\pi}\ \frac{4\pi}{\sqrt{3}}\ \frac{1}{2} \times \text{Friction (circular pile)}\\ &= (1.28) \times \text{Friction (circular pile).}\end{aligned}$$

The friction produced by the same volume of concrete is therefore 28% higher when the concrete forms a triangular pile than when the concrete forms a circular pile. In addition, the pile shown in FIG. 2 has the flanges 32 which provide a large surface area, and therefore a large increase in friction, with only a relatively small increase in the volume of concrete required.

A similar analysis to the one given above shows that a square pile (without flanges) has a performance enhanced by approximately 12%. The performance of a hexagonal pile (without flanges) in enhanced by about 5%.

It is due to the increased surface area and consequent frictional resistance created by the fins that the use of a vibrator to drive and withdraw the pile is desirable. The pile cannot be simply pulled from the hole it has formed by applying an upwardly directed pull as the force required would be too great for normal apparatus to produce. A vibrator can be reversed to readily provide sufficiently great upwardly directed force.

Variations and modifications to the heads described above, and consequently to the resulting piles, can be made without departing from the scope of the present invention.

Figure 3:
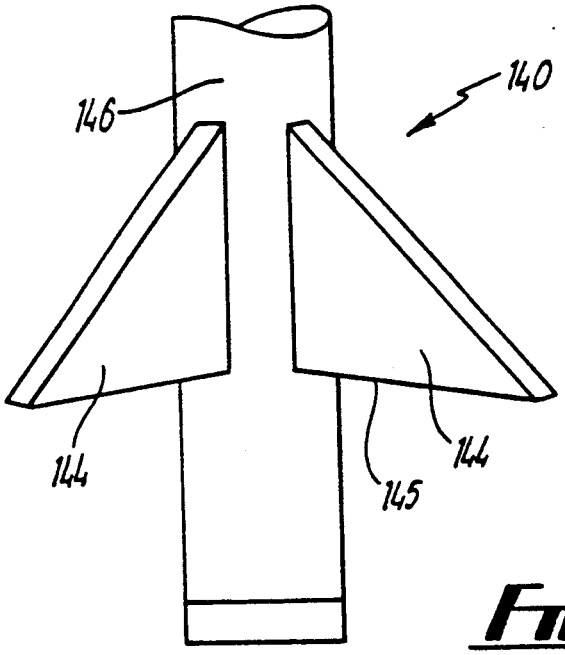
FIG. 3 is an elevation of a further alternative head.

A most useful number of fins is three and a head 140 with three fins 144 is shown in FIG. 3. The fins 144 are substantially triangular in shape and parallel sided. The leading edge 145 of each fin is substantially perpendicular to the axis of the pipe 146. Advantageously the pipe is of the form described in our co-pending U. K. Patent Application 8914764.

In each of the embodiments described above at least one steel reinforcing bar is located in the pile before the cementitious mixture has set to provide reinforcement. In view of the relatively small diameter of the circular cross-section pile core this is an important feature.

I claim:

1. A method of forming a pile, comprising:

(a) providing a pile forming member having no less than three and no more than four fins projecting transversely thereof;

(b) applying a downwardly directed force to said pile forming member to drive said member into the ground to a predetermined depth;

(c) driving the pile forming member into the ground to form a passage in the ground having a cross-section corresponding to that of the member and fins; and (d) applying an upwardly directed vibratory force to withdraw said member from the ground;

(e) supplying a pile forming material through the member simultaneously with the step of (d) to fill said passage as the member is withdrawn therefrom thereby creating a pile having a cross-section corresponding to that of the member and fins.

2. A method of forming a pile as claimed in claim 1, wherein the step of applying a downwardly directed force to the member includes the step of applying a downwardly directed vibratory force thereto.

3. A method of forming a pile as claimed in claim 1 or 2, and including the step of positioning a reinforcing member in the passage before the pile forming material sets.

4. A method according to claim 1, wherein the step of providing a pile forming member includes forming the pile forming member with a triangular cross-section.

5. A method according to claim 4, wherein the step of providing a pile forming member includes superimposing the fins on said triangular cross-section member.

6. A method according to claim 1, characterized in that each fin is superimposed on an outline which is otherwise circular.

7. A pile formed in accordance with the method of claim 1, 2, 4, 5, 6.

* * * * *